US007878025B2

(12) United States Patent
Rydlewicz

(10) Patent No.: US 7,878,025 B2
(45) Date of Patent: Feb. 1, 2011

(54) OVAL SHAPED DIAMOND CUT HAVING HEARTS AND ARROWS PATTERN

(75) Inventor: Roni Rydlewicz, Brussels (BE)

(73) Assignee: SanDiamond USA, Corp., New York, NY (US)

( * ) Notice: Subject to any disclaimer, the term of this patent is extended or adjusted under 35 U.S.C. 154(b) by 255 days.

(21) Appl. No.: 11/744,606

(22) Filed: May 4, 2007

(65) Prior Publication Data

US 2008/0271488 A1 Nov. 6, 2008

(51) Int. Cl.
*A44C 17/00* (2006.01)

(52) U.S. Cl. ..... 63/26; D11/90

(58) Field of Classification Search ..... None
See application file for complete search history.

(56) References Cited

U.S. PATENT DOCUMENTS

2007/0186585 A1 * 8/2007 Matsumura et al. ..... 63/32

* cited by examiner

*Primary Examiner*—Jack W. Lavinder

(57) ABSTRACT

An oval shaped diamond, adapted to display a hearts and arrows pattern when exposed to light characteristic of the hearts and arrows pattern in a round diamond, comprising: an oval shape having two long sides symmetrical to each other, two short sides symmetrical to each other and four corner sides symmetrically located between the long sides and the short sides respectively, eight main crown facets of unequal size and eight main pavilion facets of unequal size, sixteen pavilion half facets; a girdle of non-uniform thickness separating the crown and pavilion facets and two subsidiary pavilion facets in alignment with each other on the long sides of the diamond adjacent a main pavilion facet.

8 Claims, 4 Drawing Sheets

OVAL SHAPED DIAMOND CUT HAVING HEARTS AND ARROWS PATTERN

FIELD OF THE INVENTION

The present invention relates to the field of cut diamonds and more particularly to an oval shaped diamond with its facets cut to generate a hearts and arrows pattern when exposed to light substantially comparable to the hearts and arrows pattern generated by an ideal round cut diamond.

BACKGROUND OF THE INVENTION

A hearts and arrows pattern is successfully generated from within a round cut diamond when exposed to light, provided that the round diamond is cut into a nearly perfect round shape possessing equal and symmetrically cut facets with its angular proportions polished within relatively narrow ranges, as taught below in Table I. The symmetry of a near perfect round cut diamond provides brilliance, color and optical light handling properties which have not been matched in the marketplace by any other shaped diamond to date. Although diamonds are typically cut into many different geometrical shapes other than round such as, for example, a heart shape, oval, pear, marquis, princess, emerald, etc., only the round cut diamond has a nearly perfect symmetrical shape. It is widely believed in the diamond industry that all crown and pavilion facets should be cut with exact angle degrees and preferably with the angle differences between all pavilion angles smaller than 0.3°, the angle tolerance between the four main crown facets smaller than 0.4° and the angle tolerance for the four subsidiary crown facets smaller than 0.3° if a hearts and arrows pattern is to be achieved. This rational lies behind the belief in the diamond industry that it is impossible to obtain a hearts and arrows pattern on any shape other than round since only the round shape with its perfect symmetry can be cut to satisfy symmetrical angular tolerances with perfectly equal polished facets and without much difficulty. Since an oval shaped diamond has, by definition, a non-symmetrical geometry with two very long sides and two short sides, obtaining a hearts and arrows pattern in an oval shaped diamond contradicts conventional thinking. Moreover, oval shaped diamonds are traditionally cut using the same angle degrees on the main crown facets and a very wide range of pavilion angle degrees. Accordingly, following tradition makes it impossible to create a hearts and arrows pattern in an oval shaped diamond.

In a round cut diamond, the hearts and arrows pattern appears only when the requirements for its cut facets, angle parameters and alignment relationships are as shown in the following Table 1:

TABLE 1

| |
|---|
| The shape of the diamond is perfectly symmetrical |
| 8 main crown and 24 subsidiary crown facets |
| 8 main bottom and 16 subsidiary bottom facets |
| All main facets (crown & bottom) have to be polished at a perfect 45° angel to each other |
| All facets are perfectly aligned |
| All the bottom main facets are of equal size and at an angle ranging from 40.6°-41.0° |
| All the bottom subsidiary facets are of equal size and at an angel which is exactly 1.2° steeper than the main facets (main bottom angle 40.6°-41.0° + subsidiary 41.8°-42.2°) |
| All the main crown facets are of equal size and at an angle ranging from 33.8°-35.1°. They have to be perfectly aligned on the main bottom facets. |
| All the subsidiary crown facets are of equal size and perfectly aligned on the main crown and subsidiary bottom facets and polished at an equal angle. |
| The ideal cut proportions are: total depth 59.4%-62.4%<br>crown height 14.5%-16.0%<br>girdle thickness 1.5%-2.95%<br>Roundness 99.0%-100%<br>Table size: 53.0%-57.5% |

SUMMARY OF THE INVENTION

The oval shaped diamond of the present invention displays a hearts and arrows pattern which is characteristic of the hearts and arrows pattern in a round diamond and comprises: an oval shape with two long sides and two short sides, eight main crown facets of unequal size and eight main pavilion facets of unequal size, sixteen pavilion half facets with each pavilion half facet polished substantially at the same angle degree and preferably within an angle degree range of between 42.0° and 42.6°, a girdle having a non-uniform thickness separating the crown and pavilion facets and two subsidiary pavilion facets in alignment with each other on the long sides of the diamond. The oval shaped diamond further comprises sixteen crown half facets and eight crown star facets with the eight main pavilion facets preferably polished within the range of 40.5° and 41.1° and the eight main pavilion facets preferably polished within the range of 33.8° and 35.2°. In addition, the two long sides and two short sides should be separated by curved corner sides in a relationship measured from the center of the diamond such that the short sides are longer than the corner sides and the corner sides are longer than the long side respectively. This is also true on the pavilion side in that the pavilion half facets on the corner sides should be longer than the pavilion half facets on the long sides but shorter than the pavilion half facets on the short sides. This results in the uneven thickness for the girdle causing the girdle to be thicker on the long side compared to the girdle thickness on the corner sides or the girdle thickness on the short sides.

BRIEF DESCRIPTION OF THE DRAWINGS

Other advantages will become apparent from the following detailed description of the invention when read in conjunction with the accompanying drawings of which.

DETAILED DESCRIPTION OF THE PREFERRED EMBODIMENT

Figure 1A:
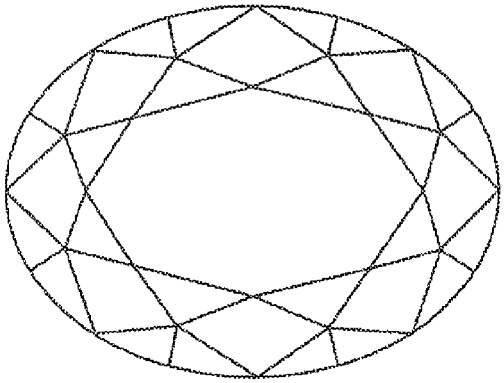
FIG. 1A (Prior Art)
FIG. 1A-1B are top views of the traditionally cut prior art oval shaped diamond shown from the table facet side with FIG. 1A showing the main crown facets and FIG. 1B showing the crown halves and crown stars in the traditionally cut prior art oval shaped diamond.
Figure 1B:
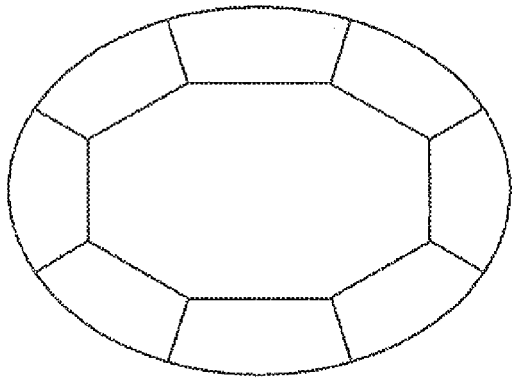
FIG. 1B (Prior Art)
Figure 2:
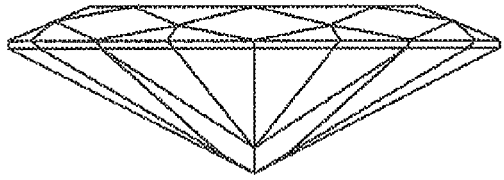
FIG. 2 (Prior Art)
FIG. 2 is a side profile view of the traditionally cut prior art oval shaped diamond.
Figure 3:
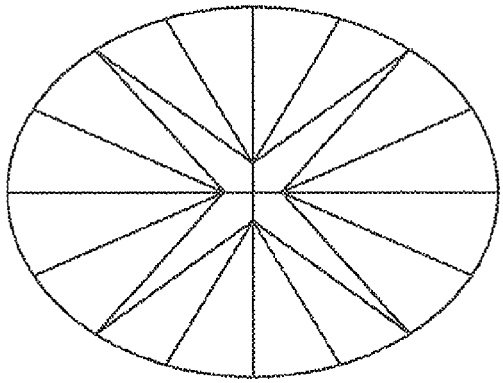
FIG. 3 (Prior Art)
FIG. 3 is a bottom view of the traditionally cut prior art oval shaped diamond showing the pavilion half facets polished on the main pavilion facets.

A diamond is a crystal which functions as a prism for dispersing light by means of reflection and refraction. The traditional oval diamond as shown in FIGS. 1-3 has eight main crown facets, eight main pavilion facets and sixteen pavilion half facets polished with different angle degrees between the main pavilion facets and polished with different angle degrees between the sixteen pavilion half facets according to their position on the oval shape. The oval diamond is traditionally polished so that the sixteen pavilion half facets are positioned in line with the oval shape. In fact, in the traditional oval diamond the main pavilion facets and the pavilion half facets are positioned in line with the shape and/or contour of the diamond and the angle degrees are selected in order for the girdle to be of uniform thickness throughout the diamond. This is shown in the profile view of a traditional oval diamond as depicted in FIG. 2 with the pavilion half facets in line with the oval shape of the diamond and with the girdle G having a uniform and even thickness throughout the diamond. Moreover, the pavilion half facets lie on the four main pavilion facets and meet each other at a point as shown in FIG. 3. This is typical for a traditional oval diamond and the crown star facets also meet each other at a point in a traditional oval diamond.

The oval shaped diamond of the present invention as is shown in FIGS. 4-8 disregards traditional teaching in almost all respects. Instead, the pavilion half facets are not positioned in line with the shape of an oval, as is traditional, and the thickness of the girdle varies throughout the diamond. Moreover, the main crown and pavilion facets are polished with very close but slightly different angle degrees and depth with the objective of providing sufficient light refraction to produce a hearts and arrows pattern. To do so, two new subsidiary pavilion facets are added to enhance a hearts and arrows pattern. In the oval shaped diamond of the present invention the long sides need to be symmetrical to each other, the short sides need to be symmetrical to each other and the corner sides need to be symmetrical to each other.

Figure 4:
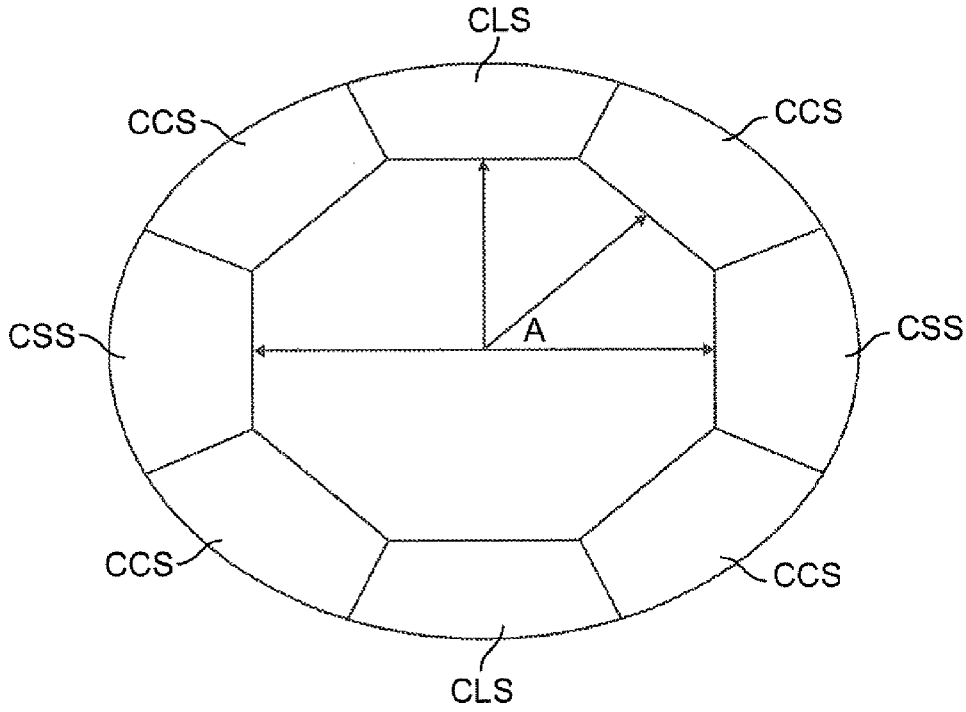
FIG. 4 is an enlarged top view of the oval shaped diamond of the subject invention, from the table facet side, showing the main crown facets on each of its sides inclusive of the long sides, the corner sides and the short sides respectively.
Figure 5:
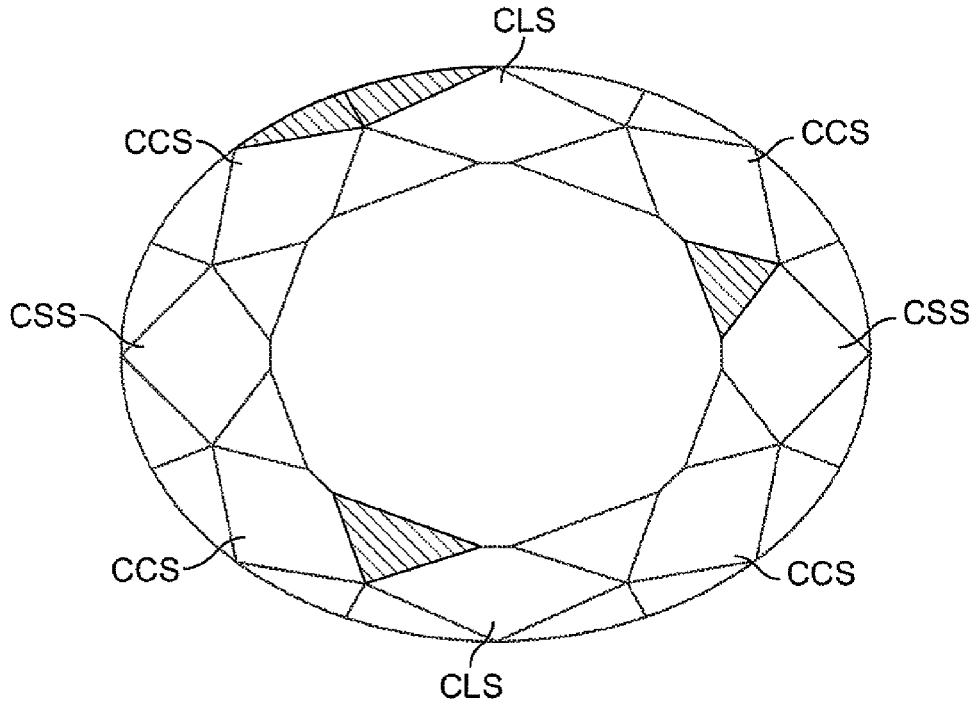
FIG. 5 is an enlarged top view similar to FIG. 4 showing the crown half facets and star facets of the oval shaped diamond of the subject invention on the long, corner and short sides of the diamond respectively.

The oval shaped diamond of the present invention includes the following facets:

8 main crown facets
8 main pavilion facets
16 crown half facets
16 pavilion half facets
8 crown star facets
A table facet
2 subsidiary pavilion facets FIG. 4 shows the eight main crown facets in the oval shaped diamond of the subject invention surrounding a flat table T of the diamond. Of the eight main crown facets, two crown facets designated "CLS", are oppositely aligned along the long side of the diamond, two crown facets designated "CSS" are opposite aligned along the short side of the diamond and four facets designated "CCS" are symmetrically located on the corner sides of the diamond between the crown long side facets CLS and the crown short side facets CSS. The distance measured from the center i.e., "culet" of the diamond A to the periphery of the crown short side CSS is longer than the distance from the culet A to the periphery of the crown corner sides CCS which, in turn, is greater than the distance from the culet A to the periphery of the crown long sides CLS. The crown half facets "CHF" and the crown star facets "CSF" of the oval shaped diamond of the subject invention are shown in FIG. 5 using shading to identify a limited number of star facets for illustrative purposes only. The crown half facets "CHF" and the crown star facets "CSF" are shown in FIG. 5 in relation to the crown facets on the crown long sides CLS, the crown corner sides CCS and the crown short sides CSS respectively.

Figure 6:
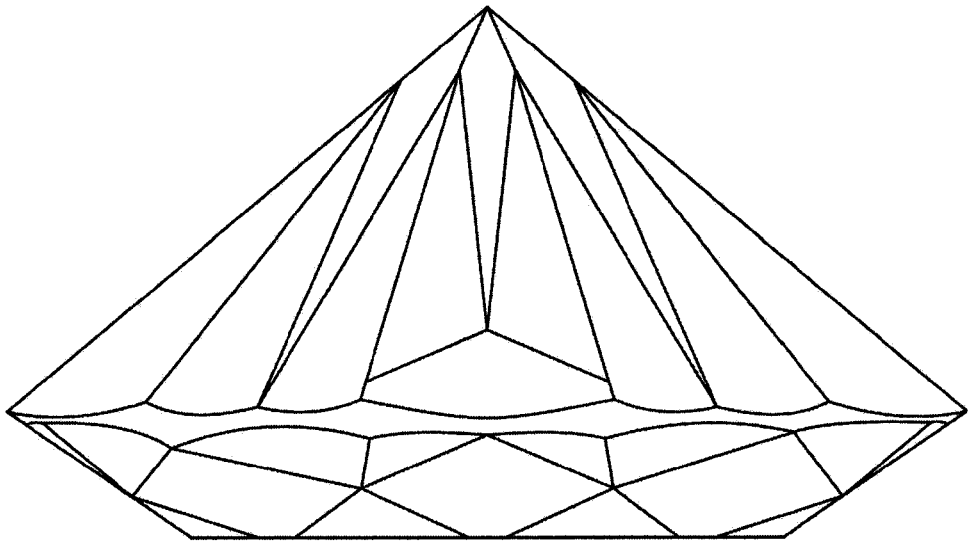
FIG. 6 is a side profile view of the oval shaped diamond of the subject invention.
Figure 7:
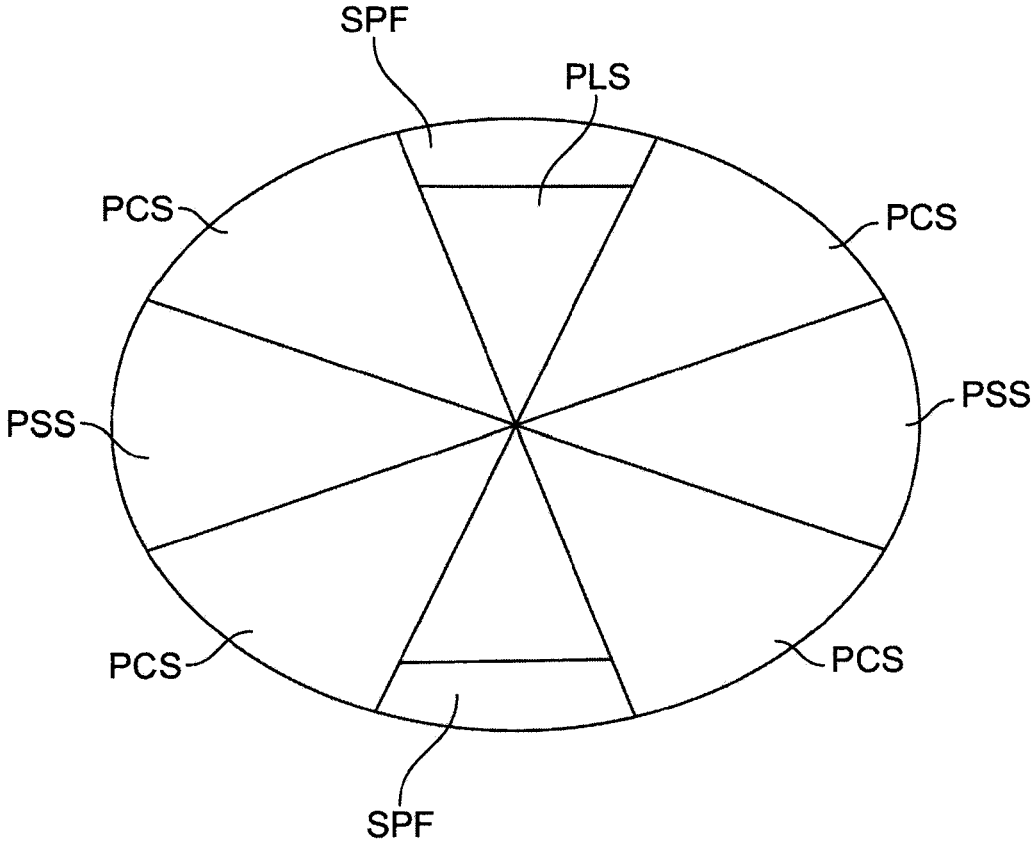
FIG. 7 is an enlarged bottom view of the oval shaped diamond of the subject invention showing the main pavilion facets and including subsidiary pavilion facets in accordance with the present invention aligned on the long side of the diamond.
Figure 8:
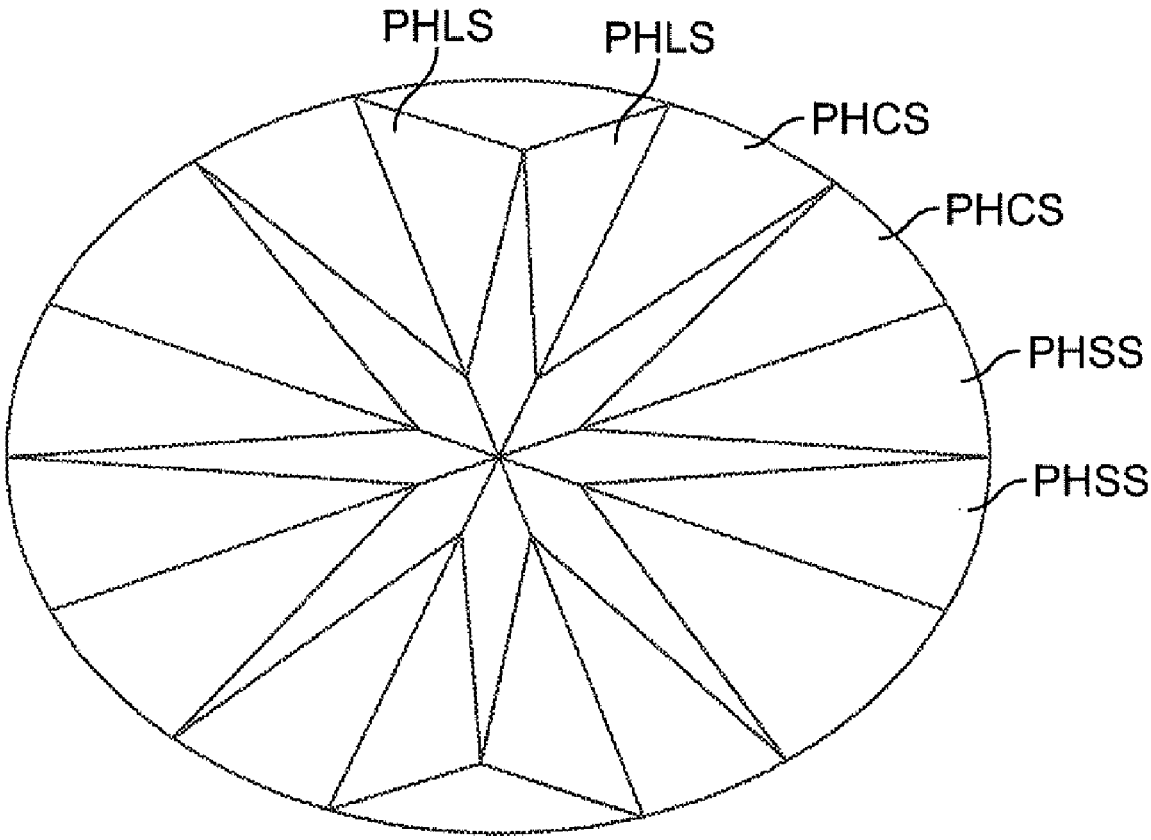
FIG. 8 is an enlarged bottom view similar to FIG. 7 showing the pavilion halves on the pavilion facets of the oval shaped diamond of the subject invention and the subsidiary pavilion facets.

FIG. 6 is a side profile view of the oval shaped diamond of the subject invention showing the girdle "G" as having a non-uniform thickness separating the crown facets on the table "T" side of the diamond from the pavilion facets on the opposite side of the diamond. It should be noted that the oval shaped diamond of the subject invention includes two subsidiary pavilion facets "SPF" shown in FIGS. 6-8 which are not present in a traditional oval cut diamond. Each of the two subsidiary pavilion facets SPF are oppositely aligned adjacent the main pavilion facets "PLS" on the long side of the diamond and between the main pavilion corner side facets "PCS" respectively. Between each of the main pavilion corner side facets "PCS" lies the main pavilion short side facets "PSS" respectively. The sixteen pavilion half facets are shown in FIG. 8 designated as pavilion half facets on the long side "PHLS", pavilion half facets on the corner sides "PHCS" and pavilion half facets on the short side "PHSS" respectively.

In the oval shaped diamond of the subject invention the main pavilion facets and the pavilion half facets are not in line with the shape of the oval but are instead in alignment with the eight main crown facets and preferably polished at 45° from each other. Moreover, as shown in FIG. 4 each of the oppositely aligned crown short side CSS facets has a parallel edge 12, 12. The same is true for the oppositely aligned crown long side CLS facets which have parallel edges 14, 14 and for the symmetrically oppositely aligned crown corner side CCS facets which have parallel edges 16, 16 and 18, 18 respectively.

In order to obtain a hearts and arrows pattern the main pavilion angles and the main crown angles have to be polished within narrow ranges. Preferably, the main pavilion angles should be within the range of 40.5° to 41.1° and the main crown angles polished between 33.8° to 35.2°. The pavilion half facets should be polished within the angle degree range of 42.0° to 42.6° but as shown in the profile view of FIG. 6 are not equal in depth (distance from culet). The depth of the pavilion half facets on the short side is greater than the depth on the long sides and the corner sides respectively. This is more clearly shown in FIG. 8 with the pavilion half facets on the corner sides PHCS being longer than the pavilion half facets on the long side PHLS but shorter than the pavilion half facets on the short side PHSS. This results in an uneven girdle G thickness. The girdle thickness, as shown in FIG. 6, is greater on the long side than the girdle thickness on the corner sides and significantly greater than the girdle thickness on the short sides. The subsidiary pavilion facets SPF are located on the long side to "artificially" reduce the discrepancies of the girdle thickness and to allow creation of arrows on the long sides of the oval shaped diamond. In addition, the subsidiary pavilion facets SPF enhance the overall beauty of the oval diamond in that it reduces the differences in girdle thickness which would otherwise exist throughout the diamond. Preferably, the subsidiary pavilion facets SPF are placed on the long sides at angle degrees of 65° to 73°.

To produce an optimal hearts and arrows pattern in an oval shaped diamond, the diamond should be cut to satisfy optimum parameters as set forth in the following Table II:

TABLE II

| | |
|---|---|
| Total Depth: | 62.0%-67.5% |
| Length/width ratio: | 1.15-1.32 |
| Pavillion Depth Average PD: | 43.0%-44.9% |
| Pavillion Depth PLS: | 40.6%-42.2% |
| Pavillion Depth PCS: | 43.8%-46.2% |
| Pavillion Depth PSS: | 45.2%-47.4% |
| Pavillion angle PLS: | 40.9°-41.2° |
| Pavillion angle PCS: | 40.6°-40.9° |
| Pavillion angle PSS: | 40.4°-40.7° |
| Subsidiary pavillion facets: | 65°-73° |
| Crown Height Average: | 14.2%-15.8% |
| Crown height CLS: | 12.6-14.7% |
| Crown height CCS: | 14.8%-16.4% |
| Crown height CSS: | 16.2%-17.6% |
| Crown angle CLS: | 34.6°-35.2° |
| Crown angle CCS: | 33.8°-34.6° |
| Crown angle CSS: | 33.2°-34.2° |
| Table size: | 53.0%-57.5% |
| Pavillion halves angle: | 42.0°-42.6° |
| Pavillion halves depth on Long sides PHLS: | 46.8%-51.4% |
| Pavillion halves depth on Corner sides PHCS: | 53.5%-55.9% |
| Pavillion halves depth on Short sides PHSS: | 55.4%-57.6% |

Pavilion halves height (as measured in distance from girdle to the cutlet point of the diamond) should be in the following range: 71.5%-78.8% Not that only the pavilion halves facets on the Long sides meet each other in a point.
Crown star angle degree range: 7.6°-12.8° flatter than main crown facet angle
Crown star facets cannot touch each other as in traditional oval cut Crown star angle CSLS: 22.4°-238°
Crown star angle CSLS: 24.0°-25.6°
Crown halves: 3.2°-8.2° steeper than the main crown facet angle depending on their location
Girdle thickness: 1%-7.5%
Culet must be polished in a point and be perfectly central: tolerance of 0.8% allowed In addition to the above parameters to achieve a hearts and arrows pattern the diamond facets for optimum beauty should be cut to satisfy the criteria in the following Table III:

TABLE III

Polishing of eight main crown facets at a 45° from each other; two main crown facets on Long sides CLS at 34.6°-35.2°, 4 main crown facets on Corner sides CCS at 33.8-34.6, and 2 main crown facets on Short sides CSS at 33.2°-34.2°
Polishing 8 main pavilion facets at a 45° from each other; two main pavilion facets on Long sides at 40.9°-41.2°, four main pavilion facets on Corner sides at 40.6°-40.9°, and 2 main pavilion facets on Short sides at 40.4-40.7°
Polishing 2 subsidiary pavilion facets on the long sides at an angel degree of 65°-73°
Polishing of 16 pavillion halves: the pavilion halves have to be polished at an angle degree range of 42.0°-42.6°. The 4 pavilion halves facets on the Short sides will touch each other near the girdle, the 8 pavillion halves facets on the Corner sides will also have to touch each other near the girdle but to a lesser extent whereas the 4 pavillion halves facets on the Long sides will meet each other in a point near the girdle see sketch 7
Polishing of 16 crown halves at a 3.8°-8.2° steeper than the main pavilion facets depending on their location
Polishing of 8 crown stars, the crown star facets have to be such that they do not meet each other in a point. Eventhough this is highly unusual it is nonetheless necessary as it would otherwise adversely affect the appearance of 8 clear arrows.

What is claimed is:

1. An oval shaped diamond, adapted to display a hearts and arrows pattern when exposed to light characteristic of the hearts and arrows pattern in a round diamond, having an oval shape including two long sides symmetrical to each other, two short sides symmetrical to each other and four corner sides symmetrically located between the long sides and the short sides respectively, and comprising eight main crown facets of unequal size surrounding a flat table and eight main pavilion facets of unequal size, sixteen pavilion half facets; a girdle of non-uniform thickness separating the crown and pavilion facets and two subsidiary pavilion facets in alignment with each other on the long sides of the diamond adjacent a main pavilion facet wherein the eight main crown facets include two crown facets on the long side each having one edge in horizontal alignment with the long side when the long side is oriented in a horizontal direction and being aligned in parallel with one another, two crown facets on the short side having one edge in vertical alignment with the short side when the short side is oriented in a vertical direction and being aligned in parallel with one another and with the crown facets on the corner sides disposed opposite to one another with each having one side extending in a straight line between a crown facet on the long side and a crown facet on the short side and having a parallel relationship with one another.

2. An oval shaped diamond as defined in claim 1 wherein each pavilion half facet is polished substantially at the same angle degree within a range of between 42.0° and 42.6° relative to a horizontal plane through the diamond when the flat table of the diamond is aligned with the horizontal.

3. An oval shaped diamond as defined in claim 2 wherein the pavilion half facets on the corner sides are longer than the pavilion half facets on the long sides but shorter than the pavilion half facets on the short sides.

4. An oval shaped diamond as defined in claim 3 wherein the girdle is thicker on the long side of the diamond compared to the girdle thickness on the corner sides or the girdle thickness on the short sides.

5. An oval shaped diamond as defined in claim 2 wherein the eight main pavilion facets are polished relative to the pavilion side of the diamond within the range of 40.5° and 41.1° and the main crown facets polished within the range of 33.8° and 35.2° relative to the flat table.

6. An oval shaped diamond as defined in claim 2 further comprising sixteen crown half facets and eight crown star facets.

7. An oval shaped diamond as defined in claim 6 wherein the main pavilion facets and the pavilion half facets are in alignment with the eight main crown facets and are polished at 45° from each other.

8. An oval shaped diamond as defined in claim 7 wherein the subsidiary pavilion facets are polished at angle degrees of between 65° to 73° relative to a horizontal plane through the diamond when the flat table of the diamond is aligned with the horizontal.

* * * * *

UNITED STATES PATENT AND TRADEMARK OFFICE

CERTIFICATE OF CORRECTION

PATENT NO. : 7,878,025 B2
APPLICATION NO. : 11/744606
DATED : February 1, 2011
INVENTOR(S) : Roni Rydlewicz It is certified that error appears in the above-identified patent and that said Letters Patent is hereby corrected as shown below:

Title Page; should read;

(73) Assignee: Worldwide Diamond Trademarks Ltd.,
Vancouver, Canada

Signed and Sealed this
Twenty-eighth Day of June, 2011

David J. Kappos

David J. Kappos
*Director of the United States Patent and Trademark Office*